United States Patent [19]

Pearce

[11] 4,402,248

[45] Sep. 6, 1983

[54] CYMBAL DRUM

[76] Inventor: John Pearce, 17667 NE. 116th, Redmond, Wash. 98052

[21] Appl. No.: 302,859

[22] Filed: Sep. 16, 1981

[51] Int. Cl.[3] ..... G10D 13/02

[52] U.S. Cl. ..... 84/411 R; 84/421

[58] Field of Search ..... 84/104, 402 C, 411–422

[56] References Cited

U.S. PATENT DOCUMENTS

| | | | |
|---|---|---|---|
| 852,881 | 5/1907 | Kendis | 84/411 |
| 1,350,975 | 8/1920 | Levy | 84/411 |
| 2,156,711 | 5/1939 | Watschinger et al. | 84/411 R |
| 3,261,253 | 7/1966 | Ulano | 84/411 |
| 3,368,442 | 2/1968 | Wilcoxon | 84/411 |
| 3,481,239 | 12/1969 | Blumenfeld | 84/418 |
| 3,482,479 | 12/1969 | Della-Porta | 84/411 R |
| 3,626,801 | 12/1971 | Moore | 84/411 R |
| 4,346,637 | 8/1982 | Janszen | 84/418 |
| 4,381,690 | 5/1983 | Kimble | 84/422 R |

*Primary Examiner*—Lawrence R. Franklin

*Attorney, Agent, or Firm*—Christensen, O'Connor, Johnson & Kindness

[57] ABSTRACT

Cymbal drum (10) includes a drum (12) having a plurality of openings (22) for receiving portions of a pair of cymbals (24) of cymbal assemblies (14), which cymbals (24) are adapted to clash together in response to the beating of the drum (12). The cymbals (24) are slidably mounted on a spindle (26) and separated by a compression spring (52). The level of the force used to beat the drum which is required to cause the cymbals to clash together may be selectively altered by varying the engagement of wing nut (48) with spindle (26). The nominal relative face-to-face alignment of the cymbals (24) may be selectively changed and the nominal relative tilting orientation of the two cymbals (24) may be selectively altered to vary the tones produced by the cymbal drum (10) of the present invention.

28 Claims, 4 Drawing Figures

CYMBAL DRUM

DESCRIPTION

TECHNICAL FIELD

This invention relates to percussion type musical instruments and more particularly to a combination cymbal drum which may be adjusted to produce different sounds.

BACKGROUND ART

The prior art includes various percussion instruments used in conjunction with a drum. U.S. Pat. No. 852,881 discloses a cymbal which is supported closely adjacent to the head of a drum by adjustable arms. A foot-actuated beater rod is positioned to strike the cymbal when a foot pedal is depressed by the musician.

In another musical instrument, a jingling sound producing instrument is mounted on the rim of a drum. The instrument includes an elongate flexible strap extending radially inwardly toward the center of the drum head from the rim. A larger, rigid arm also extends radially inwardly from the rim to overlie a portion of the flexible strap. A cross member is transversely attached to the free end of the flexible strap. A plurality of pins extend upwardly from the cross member to engage through the center of a pair of nominally vertically spaced apart metal sound discs. A pair of rubber snubber members extend downwardly from the cross member to press against the drum head. A screw, which is threadably engaged with the rigid arm, may be adjusted to press downwardly against the flexible strap to increase or decrease the pressure of the snubber members against the drum head, thus varying the tone of the sound produced by the metal sound discs. In operation, when the drum is struck with a hand or a stick, the resulting vibration causes the metal sound discs, which are loosely supported by the upright pins, to vibrate and strike each other.

Another percussion instrument is disclosed by U.S. Pat. No. 3,261,253 which is composed of a sloped wooden panel supported above an underlying second wooden panel. A circular pad is affixed to the upper surface of the upper panel and an elongate support block is disposed across the underside of the upper panel to extend along the diameter of the circular shock absorbing pad. Two pairs of metal sounding members in the form of dished tambourine jingles are suspended on corresponding pins extending downwardly from the elongate block. In use, the shock absorbing pad is struck with a drum stick causing the upper panel and the two pairs of tambourine jingles to vibrate to theoretically produce simulative snare drum sounds.

A tambourine is disclosed by U.S. Pat. No. 1,350,975 which consists of a rim extending around the circumference of a circular head. Horizontal slots are formed in the rim to receive pairs of tambourine jingles. The jingles have central openings to engage over vertical posts which span across the width of the slots. When the head of the tambourine is struck with a hand or other object, the tambourine jingles vibrate against each other.

U.S. Pat. No. 3,481,239 discloses another tambourine constructed similarly to the one disclosed in the above-described '975 patent with the exception that the tambourine does not include a head. Also, the rim of the tambourine is attached to the upper end of an axially movable, foot operated shaft, such as the type used in conjunction with a "high hat". Actuation of a shaft through a foot pedal causes the tambourine jingles to vibrate against each other.

DISCLOSURE OF THE INVENTION

The musical instrument of the present invention comprises a drum having a plurality of elongate openings spaced around the circumference of the drum cylinder and a plurality of cymbal assemblies mounted on the drum with the two cymbals of each assembly extending partially through a corresponding drum opening. The two cymbals of each assembly are mounted on the drum to clash together in response to the beating of the drum. A spindle which extends diagonally from a mounting bracket extends through spindle receiving openings formed in the central portion of the cymbals. A compression spring is engaged over the central portion of the spindle to press oppositely outwardly against the central portions of the two cymbals to bias the cymbals against movement. A wing nut, threadably engaged with the free end portion of the spindle, is adjustable to vary the preload on the spring thereby altering the level of the force used to beat the drum which is required to cause the cymbals to clash together.

The spindle receiving openings are formed in each cymbal at a location offset from the center of the cymbals so that by rotation of the two cymbals relative to each other about the spindle, the face-to-face alignment of the cymbals is altered thereby changing the tone produced by the cymbals when they are clashed together. The compression spring maintains the face-to-face alignment of the cymbals while permitting them to slide along the length of the spindle toward and away from each other.

The two cymbals of each assembly are also tiltable relative to each other so that they progressively clash together rather than striking each other "squarely" thereby also producing various musical tones. This is accomplished by providing the mounting bracket with a boss portion which is askewed relative to the length of the spindle. The center portion of the distal surface of a first cymbal is pressed against the boss by the compression spring acting between the two cymbals. As a result, the spindle is tilted relative to the first cymbal. A bevel washer is engaged over the spindle between the distal surface of the second cymbal and the wing nut to press against the outer central portion of the second cymbal to thereby support the cymbal in tilted orientation relative to the spindle. The bevel washer may be rotated about the spindle to change the tilting orientation of the second cymbal relative to the first cymbal thereby varying the tone produced by the cymbal assemblies.

BRIEF DESCRIPTION OF THE DRAWINGS

The details of one typical embodiment of the present invention will be described in conjunction with the accompanying drawings in which.

BEST MODE OF THE INVENTION

Figure 1:
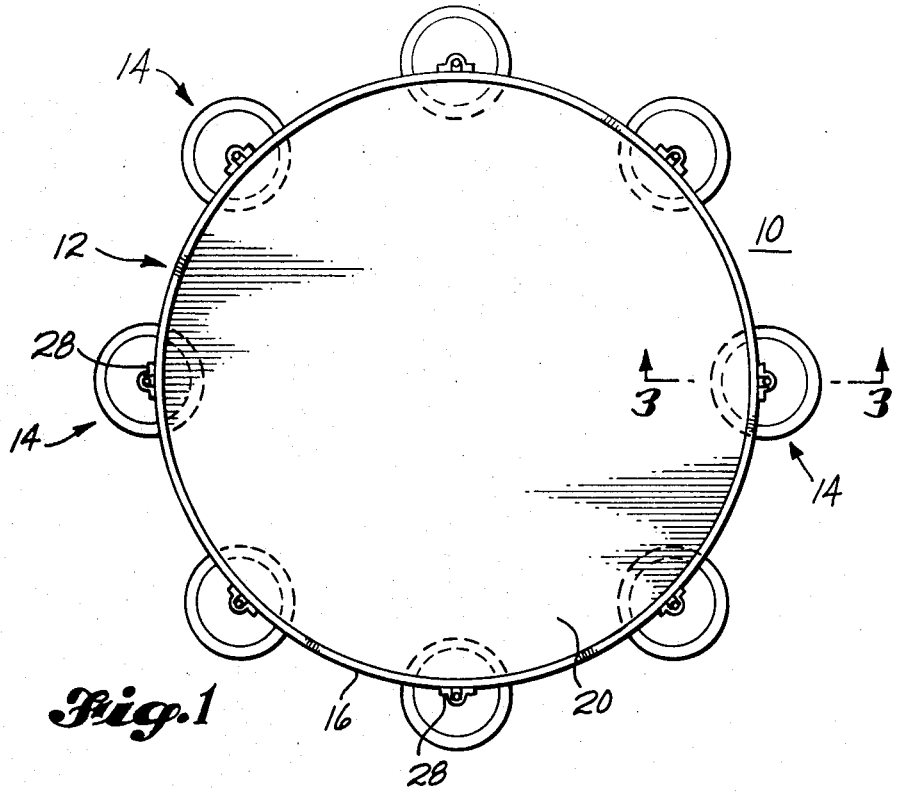
FIG. 1 is a plan view of a cymbal drum constructed according to the present invention.
Figure 2:
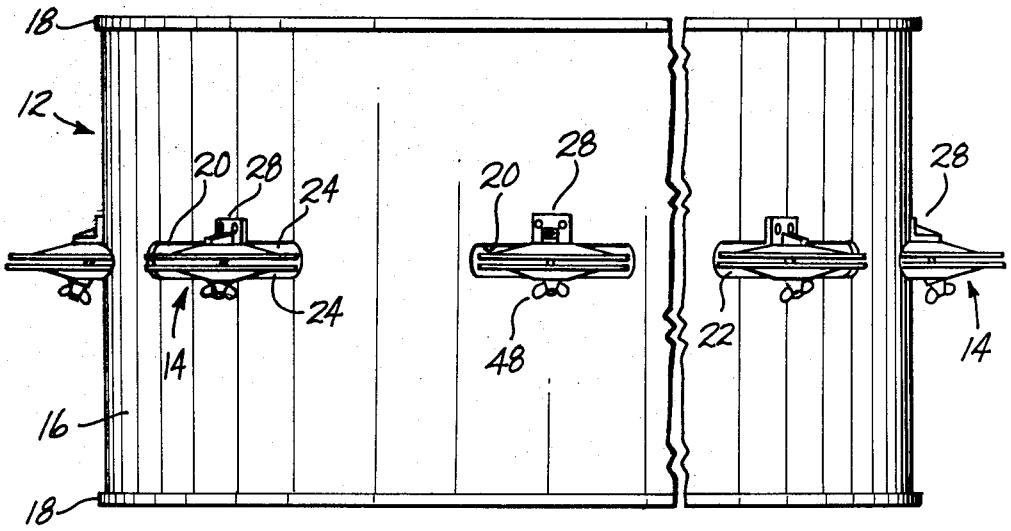
FIG. 2 is an enlarged elevational view of the cymbal drum illustrated in FIG. 1.

Referring initially to FIGS. 1 and 2, a cymbal drum 10 constructed according to the best mode of the present invention currently known to applicant is illustrated as including in basic form a drum 12 and a plurality of cymbal assemblies 14 mounted on the drum. Drum 12 includes a cylinder 16, a rim 18 formed around the circumference at each end of the cylinder and heads 20 attached to the rims to close off the ends of the cylinder. Drum 12 may be of various typical types, such as a snare drum. Additionally referring to FIGS. 3 and 4, a plurality of elongate openings 22 are formed in the drum cylinder 16 to receive portions of cymbal assemblies 14. Each opening 22 has rounded ends, the length of the openings extend along the circumference of the drum and are substantially longer than the width of the openings. Although openings 22 are illustrated as equally spaced apart along a circumferential row located approximately midway between the ends of the drum, the openings can be irregularly spaced apart and/or disposed in more than one row thereby producing different musical tones.

Each cymbal assembly 14 includes a pair of oppositely facing cymbals 24 mounted on a spindle 26 extending diagonally outward from a mounting bracket 28 secured to drum cylinder 16. Each cymbal is generally dish-shaped having a flat annular rim portion 30, a sloped intermediate portion 32 and a flat, recessed circular center portion 34 disposed parallel with a corresponding rim portion 30, FIG. 3. The cymbal center portions 34 are not located at the exact center of the cymbal, but are offset to one side. A hole 36 for receiving spindle 26 is formed on each center portion 34, with the hole also offset from the exact center of cymbal 24. Thus by rotating the two cymbals relative to each other about the spindle, the face-to-face alignment of the cymbals is altered. Preferably holes 36 are large enough to enable cymbals 24 to freely slide along spindle 26 when drum 12 is beaten.

Figure 3:
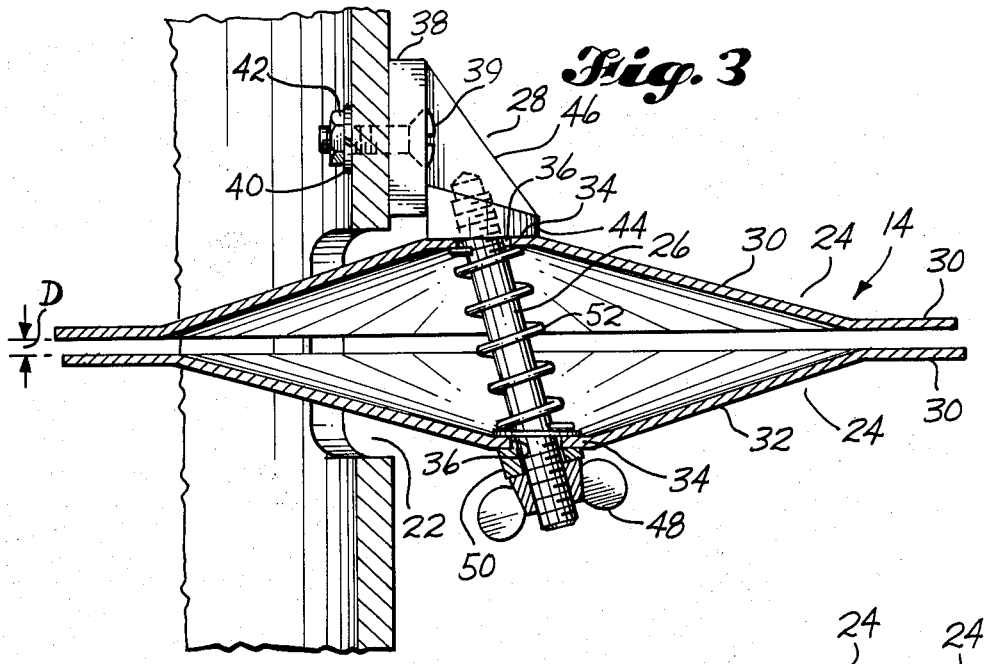
FIG. 3 is an enlarged, fragmentary, partial cross sectional view of the cymbal drum illustrated in FIG. 1, taken substantially along lines 3—3 thereof and specifically illustrating the construction of a cymbal assembly.
Figure 4:
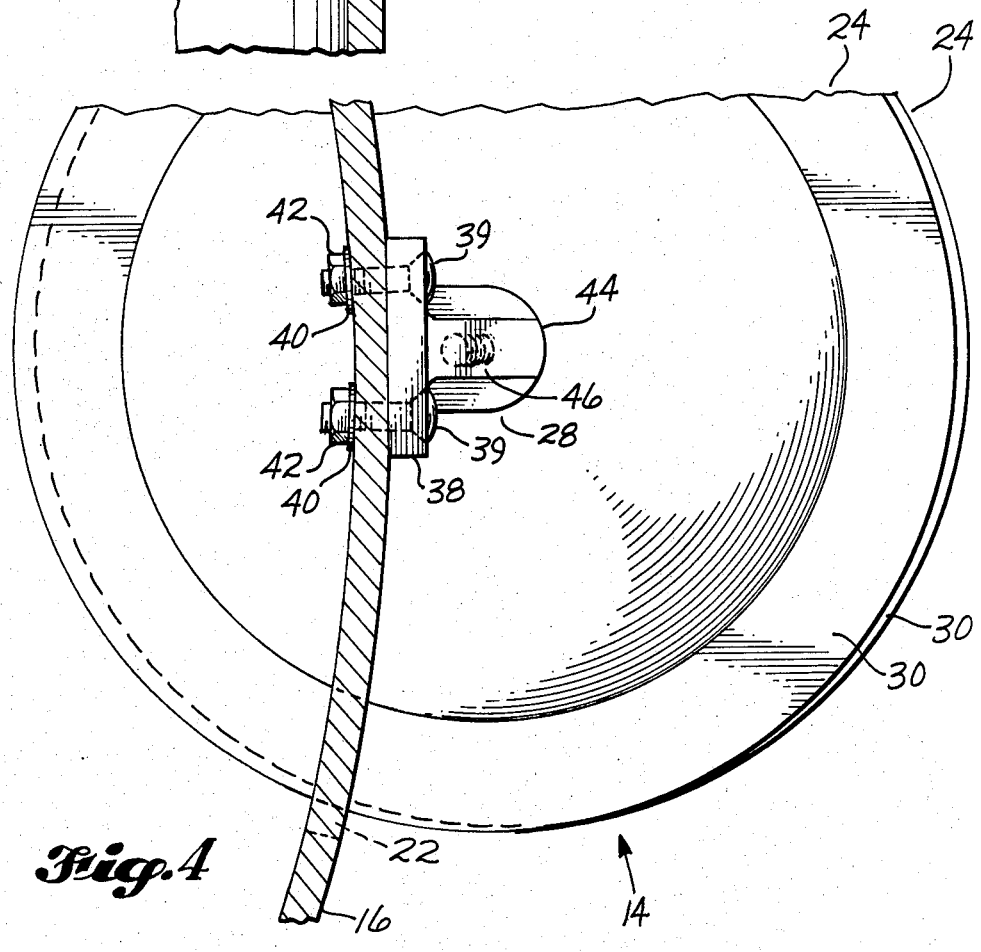
FIG. 4 is an enlarged, fragmentary, top view of the cymbal assembly illustrated in FIG. 3, with the drum cylinder shown in cross section.

Referring specifically to FIGS. 3 and 4, the inner end of spindle 26 is threadably engaged with mounting bracket 28 secured to the outer surface of drum 12. Each mounting bracket 28 includes a mounting flange portion 38 formed with two spaced apart, counter-sunk clearance holes for receiving screws 39 which also extend through aligned clearance holes formed in drum cylinder 16 to engage with appropriate hardware disposed on the inside of the drum cylinder, such as lock washers 40, and nuts 42. Rather than using screws 39, lock washers 40 and nuts 42 to attach bracket 28 to drum 12, other types of hardware such as rivets may be employed. As illustrated in FIG. 4, ideally mounting flanges 38 are curved to correspond to the circumference of drum cylinder 16; however, this curvature is not absolutely essential since flanges 38 are rather short in length in comparison to the circumference of the drum cylinder. Mounting bracket 28 also includes a spindle receiving boss portion 44 interconnected with mounting flange portion 38 by a triangularly shaped web 46. Boss portion 44 bears against the upper surface of the center portion 34 of the upper cymbal 24. Although not essential to the present invention, the cymbal contacting surface of boss portion 44 is parallel to the drum heads 20.

As best illustrated in FIG. 3, spindle 26, which extends downwardly from mounting bracket 28 and outwardly away from drum cylinder 16, is askewed relative to the central axes of the two cymbals 24. A wing nut 48 is threadably engaged with the lower or free end portion of spindle 26 to prevent the cymbals from disengaging from the spindle. A bevel washer 50 is engaged over the free end portion of spindle 26 and interposed between wing nut 48 and the lower surface of central portion 34 of the lower cymbal 24 to support the lower cymbal while accommodating the askewed orientation of spindle 26. The bearing surfaces of washer 50 are askewed relative to each other to approximately the same extent to which spindle 26 is tilted from the central axes of cymbals 24. As a result, bevel washer 50 may be rotated about spindle 26 to vary the angular tilt of the lower cymbal between a first position wherein the rim portions 30 of the two cymbals 24 are disposed parallel to each other (FIG. 3) and various tilted positions in which the rim portions of the cymbals are angularly tilted relative to each other. A compression spring 52 is engaged over the central portion of spindle 26 to push against the inside surfaces of cymbal center portions 34. Spring 52 forces the upper cymbal against mounting bracket boss portion 44 and the lower cymbal against bevel washer 50.

By its unique design, the present invention provides a single instrument which is capable of producing sounds normally generated by two separate instruments, a drum and a pair of cymbals. Moreover, each of the cymbal assemblies 14 may be individually adjusted to vary the intensity with which drum 12 must be beaten before cymbals 24 are caused to clash together. This is accomplished by changing the engagement of wing nut 48 with spindle 26 thereby altering the preload imposed on spring 52 which imparts a movement-resisting biasing force on the cymbals. It will be appreciated that each of the cymbal assemblies may be adjusted so that all of the cymbal pairs 24 strike together at the same time, or alternatively each of the assemblies may be adjusted so that the cymbal pairs clash together at different times so that sounds of various tones and loudness are produced.

Moreover, the tone produced by cymbal assemblies 14 also may be altered by rotating the cymbals of each assembly relative to each other so that the rim portion of one cymbal is offset from the rim portion of the opposite cymbal when the cymbals strike each other. The friction caused by the ends of spring 52 pushing against the central portions 34 of the cymbals restrains the cymbals from rotating about spindle 26 thus maintaining them in selective face-to-face orientation while simultaneously permitting the cymbals to slide along the spindle toward and away from each other in response to the beating of the drum.

Further tonal qualities can be achieved by rotating bevel washer 50 from the orientation illustrated in FIG. 3 so that the cymbals are nominally tilted relative to each other causing their rim portions to progressively strike each other rather than allowing the entire rim portions to strike each other simultaneously. The particular angular or tilted orientations at which the cymbals 24 are positioned are maintained by compression spring 52 while still enabling the cymbals to slide along spindle 26 toward and away from each other as drum 12 is beaten. Thus, it is to be appreciated that constructing cymbal drum 10 in the manner described above enables the musical sounds produced by the instrument to be selectively varied in three different ways, by changing the level of drum beating force needed to cause the cymbals to clash together, by altering the offset or face-to-face relationship between the cymbals and by tilting the cymbals relative to each other.

Rather than constructing cymbal assembly 14 as illustrated in FIGS. 1–4, spindle 26 could be disposed parallel to the central axis of the cymbals and bevel washer 50 eliminated. The engagement of wing nut 48 on spindle 26 may be adjusted to alter the intensity with which drum 12 must be beaten before the cymbals clash together. Moreover, by forming cymbals 24 with holes 36 offset from the true center of the cymbals, the face-to-face alignment of the cymbals may be changed by rotating the cymbals relative to each other about spindle 26 so that the entire surface area of spindle rims 30 do not contact each other when the cymbals clash together. Moreover, even though spindle 26 is disposed "square" to the central axes of the cymbals, the cymbals may be tilted relative to each other by placing a bevel washer similar to washer 50 between the lower or distal surface of lower cymbal 24 and wing nut 48. The desired relative tilt between the cymbals may be obtained by varying the relative angle between the two faces of the bevel washer.

It is applicant's belief that the quality of the sound produced by the present invention is enhanced by forming oblong openings 22 in drum cylinder 16 so that portions of cymbals 24 may be disposed within the interior of the drum cylinder. This enables the different sounds produced by drum 12 and cymbal assemblies 14 to be advantageously blended together. It is possible to construct cymbal drum 10 so that cymbal assemblies 14 are disposed entirely outside of drum cylinder 16, for instance, by increasing the length of mounting bracket boss portions 44 so that spindles 26 are positioned further away from the drum cylinder. However, the quality of the sound may be somewhat diminished if the cymbal drum is constructed in this manner.

As will be apparent to those skilled in the art to which the invention is addressed, the present invention may be embodied in forms and embodiments other than those specifically disclosed above, without departing from the spirit or essential characteristics of the invention. The particular embodiment of the cymbal drum 10 described above is therefore to be considered in all respects as illustrative and not restrictive, i.e. the scope of the present invention is as set forth in the appended claims rather than being limited to the example of cymbal drum 10 as set forth in the foregoing description.

What is claimed is:

1. A musical instrument comprising:

a drum having a plurality of openings disposed about its cylinder portion; and a plurality of cymbal assemblies mounted on said drum, each cymbal assembly including:

a pair of cymbals adapted to clash together in response to the beating of the drum, the cymbals of each cymbal assembly extending partially through a corresponding drum opening, and movement-resisting biasing means for applying a biasing force on the cymbal pairs which must be overcome to enable the cymbals to clash together.

2. The musical instrument according to claim 1, wherein said drum openings are spaced around the circumference of the drum cylinder.

3. The musical instrument according to claim 1, wherein said biasing means includes resilient, compressible means acting against the two cymbals of each cymbal assembly to resist the cymbals from clashing together.

4. The musical instrument according to claim 1 or 3, wherein said biasing means includes compression spring means disposed between the two cymbals of each assembly.

5. The musical instrument according to claim 1, wherein each of said biasing means includes adjusting means for adjusting the level of the force used to beat the drum which is required to cause the cymbals to clash together.

6. The musical instrument according to claim 1, wherein each of said cymbal assemblies includes:

a spindle mounted on said drum cylinder and engageable through generally central portions of said cymbals for movably mounting said cymbals; and retainer means for preventing the cymbals from disengaging from the spindle.

7. The musical instrument according to claim 6, wherein each of said cymbal assemblies includes adjustable movement-resisting biasing means for applying a biasing force between said cymbal pair which must be overcome to enable the cymbals to clash together.

8. The musical instrument according to claim 7, wherein said biasing means includes a compression spring engaged over the spindle to push oppositely outwardly against the two cymbals, and said retainer means are selectively adjustable to vary the nominal compression of the compression spring thereby varying the level of drum beating force needed to cause the cymbals to clash together.

9. The musical instrument according to claim 6, wherein each of said cymbal assemblies includes means for adjusting the nominal face-to-face alignment of the two cymbals relative to each other.

10. The musical instrument according to claim 9, wherein said means for adjusting the nominal face-to-face alignment of the two cymbals relative to each other includes spindle receiving openings formed in each of said cymbals at a location offset from the center of said cymbals; and means for maintaining said cymbals in selective relative face-to-face alignment with each other.

11. The musical instrument according to claim 10, wherein said means for maintaining said cymbals in relative face-to-face alignment with each other includes a compression spring engaged over said spindle and disposed between said cymbals to press oppositely outwardly against the two cymbals.

12. The musical instrument according to claim 6, wherein each of said cymbal assemblies includes means for adjusting the nominal tilting orientation of the two cymbals relative to each other from a first position in which the rim portions of the cymbals are parallel to each other to selected tilted positions in which the rim portions of the cymbals are variously angularly tilted relative to each other.

13. The musical instrument according to claim 12, wherein means for adjusting the nominal tilting orientation of the two cymbals relative to each other includes spindle receiving openings formed in the central portions of each of said cymbals, said openings sized to enable said spindle to extend diagonally through said cymbal openings; means for tilting one of the cymbals relative to the other; and means for maintaining said cymbals in tilted orientation relative to each other while permitting said cymbals to slide along said spindle toward and away from each other.

14. The musical instrument according to claim 13, wherein said means for tilting one of the cymbals relative to the other includes a bevel washer engaged over the spindle and bearing against the central portion of one of the cymbals, said bevel washer being rotatable about the spindle to thereby alter the orientation of the associated cymbal relative to the opposite cymbal.

15. The musical instrument according to claim 13 or 14, wherein said means for maintaining said cymbals in relative tilting orientation relative to each other includes a compression spring engaged over said spindle and disposed between said spindles to press oppositely outwardly against the two cymbals.

16. The musical instrument according to claim 1, further including means for altering the nominal face-to-face alignment of the two cymbals of each assembly relative to each other so that they strike each other in selective offset relationship to each other to produce varying tones.

17. The musical instrument according to claim 16, wherein said means for altering the nominal face-to-face alignment of the two cymbals of each assembly relative to each other includes a spindle mounted on the drum, spindle receiving openings provided in each cymbal at a location offset from the center of the cymbals; and means for maintaining cymbals in selective angular orientation about the longitudinal axis of the spindle while simultaneously permitting said cymbals to slide along said spindle toward and away from each other.

18. The musical instrument according to claim 17, wherein said means for preventing said cymbals from rotating about the spindle while simultaneously permitting said cymbals to slide along said spindle includes compression spring means engaged over said spindle to press oppositely outwardly against the two cymbals.

19. The musical instrument according to claim 1, wherein each of said cymbal assemblies includes means for adjusting the nominal tilting orientation of the two cymbals relative to each other between a first position in which the rim portions of the cymbals are parallel to each other to selective tilted positions in which the rim portions of the cymbals are angularly tilted relative to each other.

20. A cymbal drum, comprising in combination:

a drum having a cylinder and a head attached to at least one end of the cylinder;

a plurality of cymbal assemblies each including a pair of cymbals; and means for mounting said cymbal assemblies on the drum cylinder so that each pair of cymbals strike each other in response to the striking of the drum, said mounting means including:

mounting the two cymbals of each assembly in selective laterally offset relationship to each other to thereby vary the tone created by the cymbals when they strike each other, and;

including movement-resisting biasing means for applying a selective biasing force between said cymbal pair which must be overcome to enable the cymbals to clash together.

21. The cymbal drum according to claim 20, wherein said mounting means includes:

a spindle having one end attached to the drum cylinder;

an off-center spindle receiving opening formed in the two cymbals of each assembly to slidably engage over the spindle;

compressible means mounted on said spindle between the two cymbals of an assembly to press oppositely outwardly against the cymbals to maintain the cymbals nominally separated from each other and to maintain the two cymbals in selective laterally offset relationship to each other while simultaneously permitting the two cymbals to slide along said spindle toward and away from each other in response to the striking of the drum; and means for selectively adjusting said compressible means to vary the biasing force separating the cymbals which must be overcome to cause the cymbals to clash together.

22. The cymbal drum according to claim 21, wherein said mounting means includes means for mounting the two cymbals of each assembly on said drum in selective tilting orientations relative to each other to thereby vary the tone created by the cymbals when they strike each other.

23. The cymbal drum according to claim 22, wherein said spindle extends diagonally through the cymbal openings, and further including a tilt member carried by said spindle to vary the tilting orientation of at least one of the two spindles by movement of the member relative to the spindle.

24. The cymbal drum according to claim 23, wherein said tilt member includes a bevel washer engaged over the spindle to bear against the central portion of one of the two cymbals whereupon the tilting orientation of the cymbal adjacent the bevel washer may be selectively altered by rotating the bevel washer about the spindle.

25. The cymbal drum according to claim 20, wherein said mounting means further includes means for mounting the two cymbals of each assembly in selected tilted orientation relative to each other so that the cymbals progressively strike each other when the drum is beaten to thereby vary the tone created by the cymbals.

26. The cymbal drum according to claim 25, wherein said means for mounting said cymbals in selective tilting orientation relative to each other includes;

a mounting boss attached to the drum cylinder;

a spindle extending diagonally from said mounting boss;

spindle receiving openings formed in the two cymbals to slidably engage the cymbals over the spindle in oppositely facing relationship with the central portion of a first cymbal bearing against said mounting boss;

adjustable means bearing against the central portion of the second cymbal to selectively tilt the second cymbal relative to the first cymbal; and means mounted on said spindle to maintain the two cymbals in selected tilted orientation relative to each other while simultaneously permitting the two cymbals to slide along said spindle toward and away from each other in response to the striking of the drum.

27. The cymbal drum according to claim 26, wherein said adjustable means includes a bevel washer engaged over the spindle and bearing against the central portion of the second cymbal, said bevel washer being rotatable about the spindle to thereby vary the angular tilt of the second cymbal relative to the first cymbal.

28. The cymbal drum according to claim 20, wherein said drum cylinder includes portions defining an opening adjacent each of said cymbal assemblies to at least partially receive the two cymbals of each assembly so that portions of the two cymbals are disposed within the interior of the drum cylinder.

* * * * *